United States Patent [19]

Manning

[11] Patent Number: 4,712,968

[45] Date of Patent: Dec. 15, 1987

[54] MECHANICAL DIGGER TOY

[76] Inventor: George C. Manning, P.O. Box 6001, Saskatoon, Saskatchewan, Canada, S7K 4E4

[21] Appl. No.: 797,215

[22] Filed: Nov. 12, 1985

[30] Foreign Application Priority Data

Nov. 13, 1984 [CA] Canada ..... 467,710

[51] Int. Cl.[4] ..... E02F 3/358

[52] U.S. Cl. ..... 414/694; 180/329; 180/331; 414/719; 414/915; 446/426; 446/427

[58] Field of Search ..... 414/694, 719, 915; 180/329, 331; 446/425–428

[56] References Cited

U.S. PATENT DOCUMENTS

| | | | |
|---|---|---|---|
| 2,478,084 | 8/1949 | Brown | 414/694 |
| 2,896,802 | 7/1959 | Hope et al. | 414/694 |
| 4,224,007 | 9/1980 | Chabot | 414/915 |

*Primary Examiner*—Robert J. Spar
*Assistant Examiner*—Donald W. Underwood
*Attorney, Agent, or Firm*—Louis Weinstein

[57] ABSTRACT

A toy mechanical digger includes a base frame member, a longitudinally-extending base beam pivotally mounted on the base frame for manually-actuated, 360° slewing action relative to the base frame, a seal longitudinally slidably mounted with respect to the base beam; a primary boom having a pivoted end, and intermediate end, and a remote end, the pivoted end being pivotally mounted to the forward end of the base beam, such that the remote end can be raised and lowered, the intermediate end pivotally mounted to the forward end of the seat such that forward and rearward longitudinal sliding movement of the seat is linked to the lowering and raising movements, respectively, of the primary boom; a secondary boom having a pivoted end and a remote end, the pivoted end mounted on the remote end of the primary boom for pivotal movement relative thereto. A bucket is pivotally mounted on the remote end of the secondary boom, whereby the primary boom, the secondary boom and the bucket can be manually actuated to dig and dump. Two separate, manually-actuable, mechanical operators are mechanically connected to the secondary boom and to the bucket. A user, sitting on the seat can by manual operation of the seat and the two operators cause the primary boom to pivot with respect to the base frame, cause the secondary boom to pivot with respect to the primary boom, and cause the bucket to pivot vertically with respect to the secondary boom.

9 Claims, 4 Drawing Figures

MECHANICAL DIGGER TOY

BACKGROUND OF THE INVENTION (i) Field of the Invention

This invention relates to a toy device for simulating the action of a real mechanical digger.

(ii) Description of the Prior Art

Real mechanical diggers generally have four independent functions or movements including a primary boom which is pivoted at a lower end for raising and lowering, a secondary boom pivoted on the remote end of the primary boom so as to provide a knee action, a bucket mounted on the end of the secondary boom and pivotal through digging movement relative to the secondary boom. In addition the whole arm provided by the first and secondary booms and the bucket is pivotal about a vertical axis.

In commerical devices of this type, hydraulic power is used to drive the pivotal motion employing separate piston and cylinder units for lifting the primary boom, pivoting the secondary boom and pivoting the bucket.

Such an arrangement using hydraulic power is, however, totally unsatisfactory for toys in view of the cost and also in view of the safety factor. Various proposals have previously been made for mechanically actuated or lever actuated devices, but these have been severely limited and have not provided the four independent functions or movements which are necessary accurately to simulate the above mechanical digger.

Some such patented device is disclosed in U.S. Pat. No. 1,827,541 patented Oct. 13, 1931 to O. F. Opperman; in U.S. Pat. No. 2,247,619, patented July 1, 1941 by J. Penica and in U.S. Pat. No. 4,224,007, patented Sept. 23, 1980 by G. Chabot. Nevertheless, such toys did not accurately simulate the action of a real mechanical digger especially where such toy was to be used by children of different sizes and weights.

SUMMARY OF THE INVENTION (i) AIMS OF THE INVENTION

Among the objects of the present invention are to provide a toy device for simulating the action of a real mechanical digger which provides a four function or movement device, which toy device is simple and economical to manufacture, is safe for even very young children to operate, and is operable employing no power source other than the child's muscles.

(ii) STATEMENT OF INVENTION

The present invention therefore provides a toy mechanical digger for simulating the action of a full size hydraulic excavator, the toy mechanical digger comprising: (a) a base frame member; (b) a longitudinally-extending base beam pivotally mounted on the base frame member for manually-actuated, 360° slewing action relative to the base frame member; (c) a seat, including means for longitudinally slidably mounting it with respect to the longitudinally-extending base beam; (d) a primary boom having a pivotal end, and intermediate end, and a remote end, the pivoted end being pivotally mounted to the forward end of the base beam for pivotal movement about a first horizontal axis, such that the remote end can be raised and lowered, the intermediate end being pivotally mounted to the forward end of the seat such that forward and rearward longitudinal sliding movement of the seat is linked to lowering and raising movements, respectively, of the primary boom; (e) a secondary boom having a pivoted end and a remote end, the pivoted end being pivotally mounted on the remote end of the primary boom for pivotal movement relative thereto about a second horizontal axis; (f) a bucket pivotally mounted on the remote end of the secondary boom for pivotal movement relative thereto, whereby the primary boom, the secondary boom and the bucket can be manually actuated to dig and dump; and (g) two separate, manually-actuable mechanical operators mechanically connected by linkage members and pivot means, one operator to the secondary boom and the other operator to the bucket; whereby a user, sitting on the seat can be manual operation of the slidably mounted seat and manual operation of the two mechanical operators cause the primary boom to pivot vertically with respect to the base frame member, cause the secondary boom to pivot vertically with respect to the primary boom in a knee-like action, and cause the bucket to pivot vertically with respect to the secondary boom in an ankle-like action.

(iii) OTHER FEATURES OF THE INVENTION

By one feature of the invention, the means for longitudinally slidably mounting the seat comprises a cam mounted on the longitudinally-extending base beam by a manually-adjustable means whereby the angle of slope of the cam to the horizontal can be manually adjustable; and the two separate, manually-actuable, mechanical operators include a pair of hand-actuable levers arranged to be grasped by a user of the toy device, one lever being connected by a link to the secondary boom, and the other lever being connected by a pair of pivotally-connected, linkage means to the primary boom via a bell crank, and on to the bucket.

By another feature of the invention, the cam comprises a sloped cam having a forward end vertically adjustably supported on a forward ear on the longitudinally extending base beam by means of a forward vertical slide in the cam and manually-adjustable bolt means passing through the slide and secured to the forward ear, and a rear end vertically adjustably supported on a rear ear on the longitudinally-extending base beam member by means of a rear vertical slide in the cam and manually-adjustable bolt means passing through the slide and secured to the rear ear, whereby adjustment of the slope offsets differences in weight of different users; and the rear of the seat being supported on a roller which is adapted to roll forwardly and rearwardly on the sloped cam to allow for rolling longitudinal movement of the seat with respect to the cam; whereby a user, sitting on the seat can cause the seat to be rolled longitudinally along the cam, the rolling longitudinal movement of the seat being linked to the raising and lowering of the primary boom, and whereby the weight applied by the user of the toy device to the seat tends to counterbalance the weight of the primary boom, the secondary boom, the bucket and any load held in the bucket.

By another feature of the invention, 360° slewing action of the longitudinally-extending base beam with respect to the base frame member is achieved by the user of the toy device, sitting on the seat, pushing with his feet in the desired direction on the base frame member.

In such toy device, the hand levers may be pivotally, coupled to the primary boom at the interconnection of the primary boom to the seat. By another feature of this invention, one hand lever is a first-class lever, whose fulcrum is at the pivotal interconnection of the primary boom to the seat, one end of the lever being connected to the secondary boom by a link, which has one end pivotally connected to that end and which has its other end pivotally connected to the secondary boom at a location adjacent the pivotal interconnection between the primary boom and the secondary boom, whereby more movement of the lever is required to move the secondary boom at an open position thereof than at a closed position thereof.

By another feature of the invention, the other hand lever is a second-class lever whose fulcrum is at the pivotal interconnection between the primary boom and the seat, that lever being interconnected to the bucket by a first link, which is pivotally connected at one end to the lever and which is connected at its other end to a first pivot point of a bell crank, and by a second link, which is pivotally connected at one end to a second pivot point of the bell crank, and, which is connected at its other end, to an operator of the bucket.

By still another feature of the invention, the bell crank is provided with two base pivot points and one apex pivot point of a triangulated set of pivot points, one base pivot point being the pivot point of the second link, and the second base pivot point being a point of pivotal connection of the bell crank to a point on the primary boom adjacent the pivotal interconnection between the primary boom and the secondary boom, whereby the pivotal connection point of the second link to the bell crank is as close to the pivotal interconnection between the primary boom and the secondary boom as possible, and whereby the distance between the pivotal connection point of the second link to the bell crank and the pivotal connection point of the bell crank to the primary boom is long relative to the distance between the coupling of the link to the bucket and the pivotal connection between the bucket and the secondary boom.

By yet another feature of the invention, the base frame member includes two rear wheels and two front skids, and the toy device includes means for locking the seat and the boom against both slewing movement and rearward longitudinal movement, the means comprising a first locking pin adapted to be inserted in aligned apertures in the base frame member and the longitudinally-extending base beam, thereby to prevent slewing motion of the base beam with respect to the base frame, and a second locking pin adapted to be inserted in a selected hole in a flange portion of the cam, thereby to prevent rearward longitudinal movement of the seat with respect to the base beam; whereby lifting of the bucket raises the skids from the ground to allow towing of the toy device on the bucket and on the rear wheels.

GENERALIZED DESCRIPTION OF FEATURE OF THE INVENTION

Because of the digging capability yielded by the four function action as above described, the toy appeals both to young children and older children and even adults providing a variety of actions that holds the interest of a user for a long period of time. The novel design makes it simple enough for even a two year old to operate and the design can be used to compensate for the limited strength of a small child.

The four movements or functions provide a resulting action which gives "reach" to the bucket and the bucket can dig and entrap or dump earth at any point within the "reach". As earth can be removed or dumped anywhere to the operator's wishes, the variety of shapes of possible excavations is endless.

The four functions can therefore be achieved by the pair of levers and also by movement of the seat on which the user sits providing a forward and backward longitudinal movement linked with the raising and lowering of the primary boom and also rotational movement to rotate the whole arm.

A cam which can be adusted to slope at a variable angle is used to offset differences in weight of the user so the toy can be adjusted for easy manipulation by a thirty pound child up to a two hundred pound adult.

The levers actuate the secondary boom and the bucket by mechanical interconnections arranged such that greater mechanical advantage is provided at the extending position of the secondary boom and bucket at which a digging stroke is initiated with the mechanical advantage decreasing during the digging stroke.

BRIEF DESCRIPTION OF THE DRAWINGS

In the accompanying drawings.

DETAILED DESCRIPTION OF THE DRAWINGS

Figure 1:
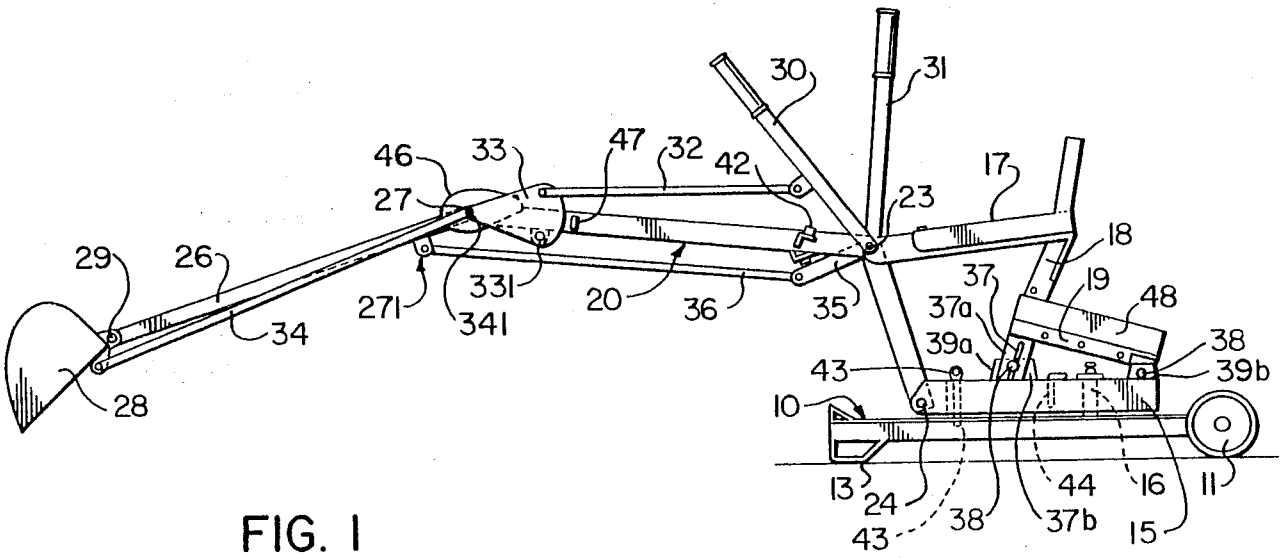
FIG. 1 is an elevational view from one side of a toy according to one embodiment of this invention with the secondary boom and bucket in an extended position prior to a digging stroke.
Figure 2:
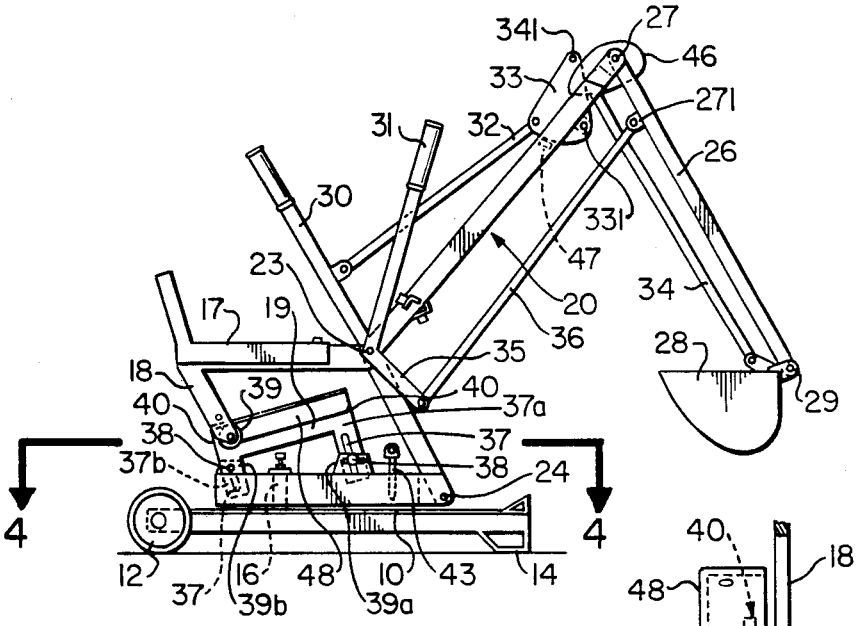
FIG. 2 is a side elevational view from the other side of the toy shown in FIG. 1, with the booms and bucket in a retracted position subsequent to a digging stroke.
Figure 4:
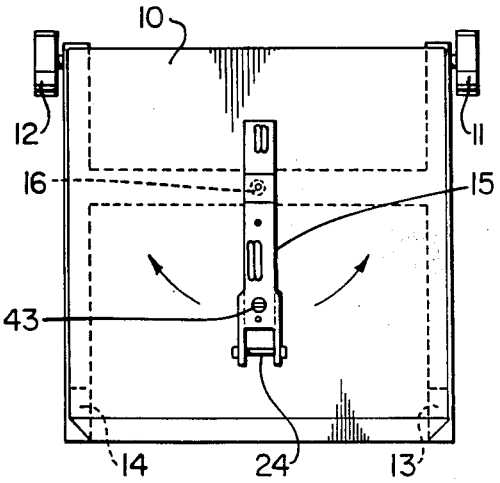
FIG. 4 is a plan view of the platform and support beam taken on the lines 4—4 of FIG. 1.

(i) DESCRIPTION OF FIGS. 1, 2, and 4

The toy device of the embodiment of this invention comprises a base frame member or platform 10 which is rectangular and which is mounted on two wheels 11 and 12 at rear corners thereof, together with two slide supports or front skids 13 and 14 at the front corners thereof.

A longitudinally-extending base beam 15 is pivotally mounted on a vertical pin 16 so that the base beam 15 can be slewed or rotated up to 360° in a horizontal plane around the pin 16. The base beam 15 carries a seat 17 for co-rotation thereof, the seat 17 being supported at a rear portion thereof by a strut 18 and by a cam 19, whose slope with respect to base beam 15 can be adjusted, as will be explained in more detail hereinafter.

A single-piece, cranked primary boom 20 is pivotally coupled to the front end of the base beam 15 at lower coupling pin 24. A front edge of the seat 17 is pivotally coupled to the primary boom 20 at a pivot pin 23. It will be appreciated, therefore, that forward and rearward longitudinal movement of the seat 17 is linked to pivotal movement of the primary boom 20 about the lower coupling pin 24 of the base beam 15. This acts to raise and lower the primary boom 20 and to pull an upper remote end thereof forwardly and rearwardly.

A secondary boom 26 is pivotally connected to the primary boom 20 at the remote end thereof of a pin 27 to provide an elbow-like action. A conventionally-shaped bucket 28 is carried on the lower end of the secndary boom 26 for pivotal movement about a pin 29 to provide a wrist-like action. Levers 30 and 31 are pivotally connected at the pin 23 so as to be pivotal both to the primary boom 20 and to the seat 17 and are coupled mechanically to the secondary boom 26 and to the bucket 28 to actuate movements thereof. Specifically, the lever 30 is connected via a link 32, bell crank 33 and link 34 to the bucket 28 to actuate pivotal movement of the bucket 28 on forward and rearward movement of the lever 30. In addition, the lever 31 is coupled by a lever portion 35 which extends downwardly from the pivot pin 23, and by a link 36 which is coupled to a point 271 on the secondary boom 26 spaced slightly from the pivot coupling 27.

In order to minimize the effect of boom flexing on the position of the bucket 28 relative to the secondary boom 26, the connection between the link 34 and the bell crank 33, indicated at 341, is arranged to be as close to the pin 27 as possible. In order to achieve this, the distance between the pivot coupling 331 of the bell crank 33 on the primary boom 20 and the pivot 341 is long relative to the distance between the coupling of the link 34 to the bucket 28 and the pin 29. In this way the desired arc of travel of the bucket 28 can be achieved with the minimum degrees of travel of the bell crank 33. Thus, pins 341 and 27 are kept as close together as possible. The pin 331 is, of course, spaced from the pin 27. Furthermore, the pins 27 and 341 are arranged to coincide or line up when the secondary boom 26 is at the mid-point of its swing and also the bucket 28 is at mid-point of its arc of travel. This gives a close approximation to keeping the pins 341 and 27 as close together as possible regardless of which extreme the secondary boom 26 or bucket 28 reaches. Thus the effect on the position of the bucket 28 relative to the secondary boom 26 caused by the motion of the secondary boom 20 is minimized.

The cam 19 comprises a simple sloped cam, the angle of slope of which to the horizontal can be adjusted by slides 37 and bolts 38. Base beam 15 is provided with forward ear **39*a* and rearward ear 39*b*. The forward end of cam 19 includes a downwardly-depending forward leg 37*a* within which is the forward slide 37 and a downwardly-depending rear leg 37*b* within which is the rear slide also numbered 37. Forward bolt 38 passes through forward slide 37 and engages with cooperating engagement means in forward ear 39*a*, so that the slope of cam 19 can be manually adjusted. Rear bolt also numbered 38 passes through aligned apertures in rear leg 37*b* of cam 19 and in rear ear 39*b*, to permit the pivotal movement of cam 19 to adjust its slope. By adjusting the slope angle of the cam 19, the effect on forward and rearward movement obtained by weight applied to the seat 17 can be varied. Due to the slope of the cam 19, weight applied to the seat 17 acts to counter-balance the weight of the booms, the bucket and the load. To achieve this effect, the front of the seat 17 is attached to the primary boom at the pin 23 but is free to pivot. The rear of the seat 17 is supported by a roller 39 which rolls on the cam 19, to provide a rolling longitudinal movement of the seat 17 with respect to the cam 19. A sheet metal flange 48 prevents the roller 39 from lifting off the cam 19. At maximum slope of the cam 19, the downward pressure of the user or operator has far more effect toward raising the primary boom than when the cam 19 is at reduced slope. Thus, the lighter the operator, the greater the slope the cam 19** should be set at. In this way the toy can handle users varying from 30 pounds to 200 pounds and yet attain a fairly neutral boom action.

Suitable stoppers 42 and 47 are provided on the primary boom 20 for the extremes of movement of the levers 30 and 31 so that th elevers 30, 31, when against the stoppers 42, 47, can be used to raise and lower the primary boom 20. A pin 43 can be moved from its storage position (seen in FIGS. 1, 2 and 4) and then be inserted in an aligned hole in base beam 15 a base frame member 10, to prevent slewing motion of the base beam 15 with respect to the base frame 10.

Figure 3:
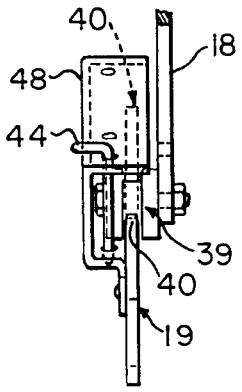
FIG. 3 is a part elevational view of the cam and follower mechanism of the toy shown in FIGS. 1 and 2.

(ii) DESCRIPTION OF FIG. 3

As seen in FIG. 3, a locking pin 44 can be taken from a storage position (shown in FIG. 1) and used to lock the seat 17 and thus the primary boom 20 in one of three forward positions. The locking pin 44 is inserted behind roller 39 in one of the three sets of holes in sheet metal flange 48 which prevents the roller 39 from lifting off the cam 19. In this way, the pin 44 prevents rearward longitudinal movement of seat 17 with respect to base beam 15.

OPERATION OF PREFERRED EMBODIMENT

(i) USE AND CONTROL OF PREFERRED EMBODIMENT

The control levers and links are designed so that leverage varies during the stroke of the levers and that maximum leverage is produced at critical points on the stroke of the bucket and the secondary boom.

Thus, the secondary boom 26 is extended by pulling on the control lever 31 and folded by pushing on the lever 31. The lever 31 is linked to the secondary boom 26 in such a way that the leverage at the hand grip of the control lever 31 is greatest when the lever 31 is fully back and therefore the secondary boom 31 is fully extended. This is achieved by making the connecting link 36 shorter than the distance between the centers on which the lever 31 and secondary boom 26 pivot. Also the control lever segment 35 swings through an arc where the angle formed between the lever segment and connecting link 36 is always close to 90 degrees of greater. Thus at the point where the secondary boom 26 is fully extended, more movement of the control lever 31 is required to move the secondary boom 26 through one degree of travel than is required as the boom 26 approaches the closed position.

The bucket 28 is rolled to the closed position shown in FIG. 2 by pulling back on the control lever 30. Similarly the bucket is opened by pushing the control lever 30. By closing the bucket, a cutting edge not only engages a load of dirt but the closed position entraps the earth so that it can be lifted to a new location. The design of the linkage system including the links 32, 34 and the bell crank 33 means that the control lever 30 has considerably more leverage when the bucket 28 is fully opened than when it is close to the closed position. This is achieved by using the same principle applied to the control of the secondary boom 26 mentioned above. The majority of digging occurs as the bucket 28 moves from the fully opened to half-closed position.

The bell crank 33 is used to transfer power to the bucket around the flexing joint provided by the pin 27.

The primary boom 20 travels through approximately 45 degrees. It is forced ahead by pushing forwardly on the seat 17 and hand lever 30 while the operator raises his weight from the seat. Stoppers 40 are provided at the front and rear extents of the cam 19. To raise the primary boom 20, the user plants his feet on the platform 10 and pulls on the bucket lever 30 while applying weight downwardly and rearwardly on the seat 17.

The movement of the bucket 28 and secondary boom 26 from the fully extended position show in FIG. 1 to the retracted position shown in FIG. 2 therefore requires lever 30 to be pulled while lever 31 is pushed. This opposing action of the levers can be simple achieved in a counter-balancing manner by the user while sitting on the seat astride the seat 17 and the primary boom 20.

Variable, 360° slewing movement of the primary boom 20 and seat 17 about the pin 16 can be obtained by the operator pushing with his feet in the desired direction on the base frame member 10. When the base beam 15 is free to slew, the primary boom 20 can be pivoted to either side for dumping. The operator simply pushes the seat 17 back against its stopper on the cam 19 and puts his full weight on the seat 17. The seat 17 and entire primary and secondary boom assembly are very stable in this rearward position. Due to the front of the seat being supported by the lower portion of the primary boom 20, and the fact that the pin 23 is now rearward of the pin 24, the operator's weight tends to lock the primary boom 20 in the "up" position. The central pivot proivded by the pin 16 is located so as to be directly below the mid-point on a line between the operator's hip joints when the seat 17 of the toy device is in the back position. This allows the operator optimal leverage with his legs to pivot the seat 17 and primary and secondary boom assembly in either direction.

A fin-shaped shield 46 is positioned at the remote end of the primary boom 20 so as to cooperate with the bell crank 33 which is in the form of a plate. The fin-shaped shield 46 and plate 33 cooperate to avoid the formation of pinch points during the movement of the bell crank 33 and thus prevent children's fingers from being pinched and damaged.

(ii) TRANSPORTATION OF THE PREFERRED EMBODIMENT

With the pins 43 and 44 in their respective locking positions, the toy device can be transported by lifting the bucket 28 to a position where the bucket 28, secondary boom 26 and primary boom 20 are all extended and lifted from the ground so that the whole toy device can be pulled as a trailer on the wheels 11 and 12. In order to reduce the amount of lifting of the primary boom 20 required to raise skids 13 and 14 off the ground, the seat 17 can be pinned at a more forward location by pin 44.

(iii) SUMMARY OF OPERATION OF PREFERRED EMBODIMENT

The four movements of the toy device therefore are provided by the levers 30 and 31 actuated by the hands of the user and also by forward and rearward longitudinal movement of the seat 17 provided by the legs and weight of the user, and slewing movement of the seat 17 on the base beam 15 by the legs of the user. At the same time the movements are all directly controlled by direct mechanical linkage so that there is no free movement and the movement is powered in both directions. The toy therefore provides an effective and simple arrangement for controlling all four movements to simulate effectively and accurately the movement of the conventional mechanical digger in an inexpensive manner using simple levers.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What I claim is:

1. A toy mechanical digger for simulating the action of a full size hydraulic excavator comprising:

(a) a base frame member;

(b) a longitudinally-extending base beam pivotally mounted on said base frame member for manually-actuated, 360° slewing action relative to said base frame member;

(c) a seat including means for longitudinally slidably mounting said seat with respect to said longitudinally-extending base beam;

(d) a primary boom having a pivoted end, an intermediate end, ane a remote end, said pivoted end being pivotally mounted to the forward end of said base beam for pivotal movement about a first horizontal axis, such that said remote end can be raised and lowered, said intermediate end being pivotally mounted to the forward end of said seat such that forward and rearward longitudinal sliding movement of said seat is linked to lowering and raising movements, respectively, of said primary boom;

(e) a secondary boom having a pivoted end and a remote end, said pivoted end being pivotally mounted on said remote end of said primary boom for pivotal movement relative thereto about a second horizontal axis;

(f) a bucket pivotally mounted on said remote end of said secondary boom for pivotal movement relative thereto, whereby said primary boom, said secondary boom and said bucket can be manually actuated to dig and dump; and (g) two separate, manually-actuable mechanical operators mechanically connected by linkage members and pivot means, one operator connected to said secondary boom and the other operator connected to said bucket;

whereby a user, sitting on said seat can independently and by manual operation only of said slidably mounted seat and of said two mechanical operators cause said primary boom to pivot vertically with respect to said base frame member, cause said secondary boom to pivot vertically with respect to said primary boom in a knee-like action, and cause said bucket to pivot vertically with respect to said secondary boom in an ankle-like action.

2. A toy device as claimed in claim 1 wherein said means for longitudinally slidably mounting said seat comprises a cam mounted on said longitudinally-extending base beam by way of a manually-adjustable means whereby the angle of slope of said cam to the horizontal can be manually adjusted; and wherein said two separate manually-actuable mechanical operators include a pair of hand-actuable levers arranged to be grasped by a user of said toy device, one said lever being connected by a link to said secondary boom and the other said lever being connected by a pair of pivotally-connected linkage means to said primary boom and said bricket via a bell crank.

3. A toy device as claimed in claim 2, wherein said cam comprises a sloped cam having a forward end vertically adjustably supported on a forward ear on said longitudinally extending base beam by means of a forward vertical slide in said cam and manually-adjustable bolt means passing through said slide and secured to said forward ear, and a rear end vertically-adjustably supported on a rear ear on said longitudially-extending base beam member by means of a rear vertical slide in said cam and manually-adjustable bolt means passing through said rear vertical slide and secured to said rear ear, whereby adjustment of the slope offsets differences in weight of different users; and wherein the rear of said seat (c) is supported on a roller which is adapted to roll forwardly and rearwardly on said sloped cam to allow for rolling longitudinal movement of said seat with respect to said cam;

whereby a user, sitting on said seat can cause said seat to be rolled longitudinally along said cam, said rolling longitudinal movement of said seat being linked to the raising and lowering of said primary boom, and whereby the weight applied by the user of the toy device to said seat tends to counterbalance the weight of said primary boom, said secondary boom, said bucket and any load held in said bucket.

4. A toy device according to claim 2 wherein said hand levers are pivotally coupled to said primary boom at the pivotal interconnection of said primary boom to said seat.

5. A toy device according to claim 3 wherein one hand lever is a lever, whose fulcrum is at the pivotal interconnection of said primary boom to said seat, one end of said lever being connected to said secondary boom by a link, said link having one end pivotally connected to said one end and having its other end pivotally connected to said secondary boom at a location adjacent the pivotal interconnection between said primary boom and said secondary boom.

6. A toy device according to claim 5 wherein the other hand lever is a lever whose fulcrum is at the pivotal interconnection between said primary boom and said seat, said lever being interconnected to said bucket by a first link, said first link being pivotally connected at one end to said lever and being connected at its other end to a first pivot point of a bell crank, and a second link, said second link being pivotally connected at one end to a second pivot point of said bell crank, and being connected at its other end to an operator of said bucket.

7. A toy device according to claim 6 wherein said bell crank is provided with two base pivot points and one apex pivot point of a triangulated set of pivot points, one base pivot point being the pivot point of said second link, and the second base pivot point being a point of pivotal connection of said bell crank to a point on said primary boom adjacent the pivotal interconnection between said primary boom and said secondary boom, whereby said pivotal connection point of said second link to said bell crank is as close to the pivotal interconnection between said primary boom and said secondary boom as possible; and whereby the distance between said pivotal connection point of said second link to said bell crank and said pivotal connection point of said bell crank to said primary boom is long relative to the distance between the coupling of said second link to said bucket and the pivotal connection between said bucket and said secondary boom.

8. A toy device according to claim 3 wherein said base frame member includes two rear wheels and two front skids; and including means for locking said seat and said boom against both slewing movement and rearward longitudinal movement, said means comprising a first locking pin adapted to be inserted in aligned apertures in said base frame member and said longitudinally-extending base beam, thereby to prevent slewing motion of said base beam with respect to said base frame, and a second locking pin adapted to be inserted in a selected hole in a flange portion of said cam, thereby to prevent rearward longitudinal movement of said seat with respect to said base beam, whereby lifting of said bucket raises said skids from the ground to allow towing of said toy device on said bucket and on said rear wheels.

9. A toy device of claim 2 wherein 360° slewing action of said longitudinally-extending base beam with respect to said base frame member is achieved by the user of said toy device, sitting on said seat, pushing with his feet in the desired direction on said base frame member.

* * * * *

UNITED STATES PATENT AND TRADEMARK OFFICE

CERTIFICATE OF CORRECTION

PATENT NO. : 4,712,968

DATED : December 15, 1987

INVENTOR(S) : George C. Manning

It is certified that error appears in the above-identified patent and that said Letters Patent is hereby corrected as shown below: Title page:

IN THE ABSTRACT

Line 4, "seal" should be --seat--

Line 6, "and intermediate" should be --an intermediate--

IN THE SPECIFICATION

Column 1, line 7, "mechanical digger" should be --hydraulic excavator--

Column 1, line 9, "mechanical diggers" should be --hydraulic excavators--

Column 1, line 30, "mechanical digger" should be --hydraulic excavator--

Column 1, line 36 and 37, "mechanical digger" should be --hydraulic excavator--

Column 1, line 44, "mechanical digger" should be --hydraulic excavator--

Column 1, line 59, "pivotal end, and" should be --pivoted end, an--

Column 2, line 12, "can be" should be --can by--

Column 2, line 64, "pivotally," should be --pivotally--

Column 3, line 59, "adults" should be --adults,--

Column 4, line 33, "of FIG. 1." should be --of FIG. 2.--

Column 4, line 46, "rotated up to 360°" should be --rotated 360°--

Column 4, line 63, "of a pin" should be --by a pin--

Column 4, line 66, "secndary" should be --secondary--

Column 6, line 3, "th elevers" should be --the levers--

UNITED STATES PATENT AND TRADEMARK OFFICE

CERTIFICATE OF CORRECTION

PATENT NO. : 4,712,968

DATED : December 15, 1987

INVENTOR(S) : George C. Manning

It is certified that error appears in the above-identified patent and that said Letters Patent is hereby corrected as shown below:

IN THE SPECIFICATION (continued from page 1)

Column 6, line 7, "a base" should be --and base--

Column 7, line 5, "simple" should be --simply--

Column 7, line 23, "proivded" should be --provided--

Column 7, line 61, "mechanical digger" should be --hydraulic excavator--

IN THE CLAIMS

Column 8, line 18, "ane" should be --and--

Column 8, line 66, "bricket" should be --bucket--

Signed and Sealed this

Tenth Day of January, 1989

*Attest:*

*Attesting Officer*

DONALD J. QUIGG

*Commissioner of Patents and Trademarks*